US010506687B1

(12) United States Patent
Tu et al.

(10) Patent No.: US 10,506,687 B1
(45) Date of Patent: Dec. 10, 2019

(54) STREET LIGHT SYSTEM AND OPERATION METHOD THEREOF

(71) Applicants: LITE-ON ELECTRONICS (GUANGZHOU) LIMITED, Guangzhou (CN); Lite-On Technology Corporation, Taipei (TW)

(72) Inventors: Chin-Jui Tu, Taipei (TW); Li-Ta Fan, Taipei (TW); Chien-Lung Wang, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 16/510,984

(22) Filed: Jul. 15, 2019

Related U.S. Application Data

(63) Continuation-in-part of application No. 16/186,591, filed on Nov. 12, 2018, now Pat. No. 10,405,399.

(30) Foreign Application Priority Data

Sep. 28, 2018 (CN) ..... 2018 1 1138205

(51) Int. Cl.
*H05B 37/02* (2006.01)
*H05B 33/08* (2006.01)

(52) U.S. Cl.
CPC ..... *H05B 37/0227* (2013.01); *H05B 37/0272* (2013.01); *H05B 33/0872* (2013.01)

(58) Field of Classification Search
CPC .. H05B 37/02; H05B 37/029; H05B 37/0245; H05B 37/0272; H05B 37/0227;
(Continued)

(56) References Cited

U.S. PATENT DOCUMENTS 6,676,279 B1 * 1/2004 Hubbell ..... F21S 8/088 362/293
9,900,960 B1 2/2018 Lin
(Continued)

FOREIGN PATENT DOCUMENTS

CN 104712966 1/2016
CN 105357812 2/2016
(Continued)

OTHER PUBLICATIONS

"Office Action of Taiwan Counterpart Application," dated Jul. 8, 2019, p. 1-p. 3.

*Primary Examiner* — Haissa Philogene
(74) *Attorney, Agent, or Firm* — JCIPRNET

(57) ABSTRACT

A street light system and operation method thereof are provided. The street light system includes a master street light device and a slave street light device. The master street light device includes a first light emitting module, a sensing module, a first microcontroller, and a first driving circuit. The slave street light device includes a second light emitting module, a second microcontroller, and a second driving circuit. The sensing module obtains a temperature, a relative humidity, and a dust concentration. The first microcontroller calculates a light attenuation rate according to the temperature, the relative humidity, and the dust concentration. The first driving circuit drives the first light emitting module according the light attenuation rate. The second microcontroller obtains the light attenuation rate. The second driving circuit drives the second light emitting module according the light attenuation rate.

20 Claims, 7 Drawing Sheets

(58) Field of Classification Search
CPC ..... H05B 33/0872; F21S 2/005; F21S 8/086; G08G 1/095; G08G 1/0104
See application file for complete search history.

(56) References Cited

U.S. PATENT DOCUMENTS

| | | | | |
|---|---|---|---|---|
| 9,955,551 | B2 * | 4/2018 | Spero | B60Q 1/04 |
| 10,234,129 | B2 * | 3/2019 | Oostdyk | F21V 29/83 |
| 10,285,241 | B2 * | 5/2019 | Recker | H05B 37/0272 |
| 10,405,399 | B1 * | 9/2019 | Fan | H05B 33/0872 |
| 2015/0346320 | A1 * | 12/2015 | Hartman | H05B 37/0227 315/312 |
| 2016/0131327 | A1 * | 5/2016 | Moon | H01L 33/58 362/235 |

FOREIGN PATENT DOCUMENTS

| | | |
|---|---|---|
| CN | 108495405 | 9/2018 |
| TW | 201405052 | 2/2014 |

* cited by examiner

STREET LIGHT SYSTEM AND OPERATION METHOD THEREOF

CROSS-REFERENCE TO RELATED APPLICATION

This application is a continuation-in-part application of and claims the priority benefit of U.S. application Ser. No. 16/186,591, filed on Nov. 12, 2018, now allowed, which claims the priority benefit of China application serial no. 201811138205.0, filed on Sep. 28, 2018. The entirety of each of the above-mentioned patent applications is hereby incorporated by reference herein and made a part of this specification.

BACKGROUND OF THE INVENTION

Field of the Invention

The disclosure relates to an illumination apparatus and, more particularly, to a street light system and an operation method thereof.

Description of Related Art

In general, street light devices beside the road are used at night or when there is poor lighting, so the illumination effect of the street light devices is an important factor affecting the users' safety when driving in the dark environment. However, for most traditional street light devices, either one fixed color temperature is adopted, or a nephelometer performs a wide-range measurement and then the color temperature of multiple street light devices may be adjusted wirelessly at the same time. Accordingly, general nephelometers require high installation cost, have limited measurement accuracy, and may have the problem of unstable connection since the nephelometers are controlled wirelessly. In view of the above, several embodiments will be presented below, illustrating how to achieve a street light device that effectively and automatically adjusts the color temperature of the illumination light to provide a good illumination effect.

SUMMARY OF THE INVENTION

A street light system and an operation method thereof that effectively provide a corresponding illumination effect according to the surrounding environment of the street light system are provided.

A street light system of the disclosure includes a master street light device and a slave street light device. The master street light device includes a first light emitting module, a sensing module, a first microcontroller, and a first driving circuit. The sensing module is configured to obtain a temperature, a relative humidity, and a dust concentration. The first microcontroller is coupled to the sensing module, and configured to calculate a light attenuation rate according to the temperature, the relative humidity, and the dust concentration. The first driving circuit is coupled to the first microcontroller and the first light emitting module, and configured to drive the first light emitting module according the light attenuation rate. The slave street light device is coupled to the master street light device. The slave street light device includes a second light emitting module, a second microcontroller, and a second driving circuit. The second microcontroller is configured to obtain the light attenuation rate. The second driving circuit is coupled to the second microcontroller and the second light emitting module, and configured to drive the second light emitting module according the light attenuation rate.

An operation method of the disclosure is adapted for a street light system. The street light system includes a master street light device and a slave street light device. The operation method includes the following steps: obtaining a temperature, a relative humidity, and a dust concentration by a sensing module of the master street light device; calculating a light attenuation rate according to the temperature, the relative humidity, and the dust concentration by a first microcontroller of the master street light device; driving a first light emitting module of the master street light device by a first driving circuit of the master street light device according the light attenuation rate; obtaining the light attenuation rate by a second microcontroller of the slave street light device; and driving a second light emitting module of the slave street light device by a second driving circuit of the slave street light device according the light attenuation rate.

Based on the above, the street light system and the operation method thereof of this disclosure calculate a light attenuation rate by instantly sensing the environmental parameters of the surrounding environment of the master street light device, so as to effectively drive the light emitting module of the master street light device according to the light attenuation rate. Moreover, the master street light device provides the light attenuation rate or the environmental parameters to the slave street light device, so that the slave street light device can directly utilize the light attenuation rate or directly calculate the light attenuation rate to quickly drive the light emitting module of the slave street light device.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
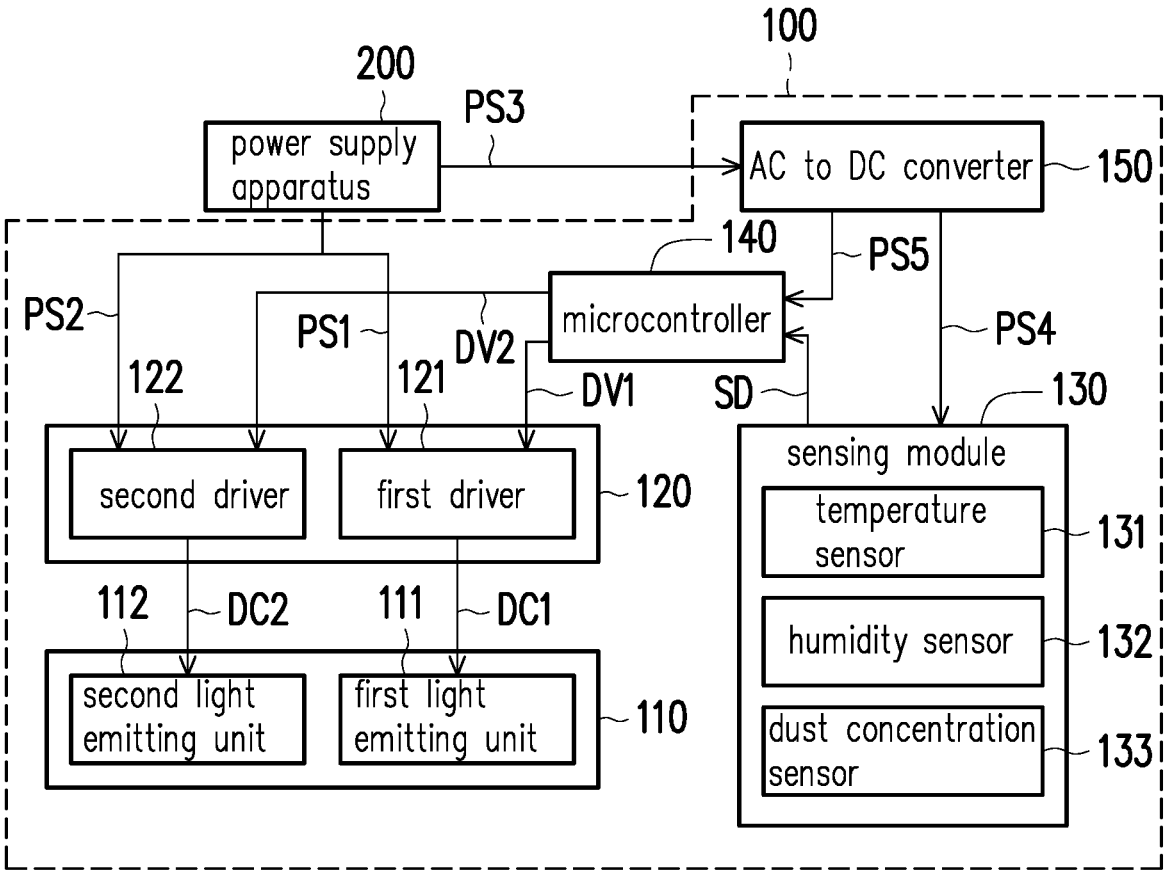
FIG. 1 is a schematic view of a functional circuit diagram of a street light device according to an embodiment of the disclosure.

In order to make the disclosure more comprehensible, several embodiments are described below as examples of implementation of the disclosure. Moreover, elements/components/steps with the same reference numerals are used to represent identical or similar parts in the figures and embodiments where appropriate.

FIG. 1 is a schematic view of a functional circuit diagram of a street light device according to an embodiment of the disclosure. Referring to FIG. 1, a street light device 100 includes a light emitting module 110, a driving circuit 120, a sensing module 130, a microcontroller 140, and an AC to DC converter 150. The street light device 100 may be coupled to an external power supply apparatus 200, and the power supply apparatus 200 may be, for example, the domestic power. The light emitting module 110 includes a first light emitting unit 111 and a second light emitting unit 112. The driving circuit 120 includes a first driver 121 and a second driver 122. The sensing module 130 includes a temperature sensor 131, a humidity sensor 132, and a dust concentration sensor 133. In this embodiment, the power supply apparatus 200 is adapted to respectively provide an AC power signal PS1 and an AC power signal PS2 to the first driver 121 and the second driver 122, and to provide an AC power signal PS3 to the AC to DC converter 150. The AC to DC converter 150 is adapted to convert the AC power signal PS3 into a DC power signal PS4 and a DC power signal PS5, and to respectively provide the DC power signal PS4 and the DC power signal PS5 to the sensing module 130 and the microcontroller 140.

In this embodiment, the temperature sensor 131 of the sensing module 130 is adapted to sense the temperature of the surrounding environment of the street light device 100 to obtain a temperature. The humidity sensor 132 of the sensing module 130 is adapted to sense the relative humidity of the surrounding environment of the street light device 100 to obtain a relative humidity. The dust concentration sensor 133 of the sensing module 130 is adapted to sense the dust concentration of the surrounding environment of the street light device 100 to obtain a dust concentration. In this embodiment, the sensing module 130 provides a sensing data SD including the above parameters to the microcontroller 140, so that the microcontroller 140 performs calculation according to the temperature, the relative humidity, and the dust concentration to obtain a light attenuation rate. Moreover, the microcontroller 140 may respectively output a first adjusting voltage DV1 and a second adjusting voltage DV2 to the first driver 121 and the second driver 122 according to the light attenuation rate, so that the first driver 121 and the second driver 122 correspondingly output a first driving current DC1 and a second driving current DC2 respectively to the first light emitting unit 111 and the second light emitting unit 112. Therefore, a color temperature ratio between the first light emitting unit 111 and the second light emitting unit 112 is determined according to the light attenuation rate calculated above.

In this embodiment, the first light emitting unit 111 and the second light emitting unit 112 may be light emitting diodes (LEDs), but the disclosure is not limited thereto. The first light emitting unit 111 and the second light emitting unit 112 are adapted to provide illumination light of different color temperatures. For example, in an embodiment, a color temperature of the first light emitting unit 111 is, for example, an illumination light of 2700K, and a color temperature of the second light emitting unit 112 is, for example, an illumination light of 5000K. In addition, the microcontroller 140 may include a central processing unit (CPU) with data processing and computing functions, or other programmable microprocessors for general use or special use, a digital signal processor (DSP), a programmable controller, an application specific integrated circuit (ASIC), a programmable logic device (PLD), other similar processing devices, or a combination of the foregoing devices.

Figure 2:
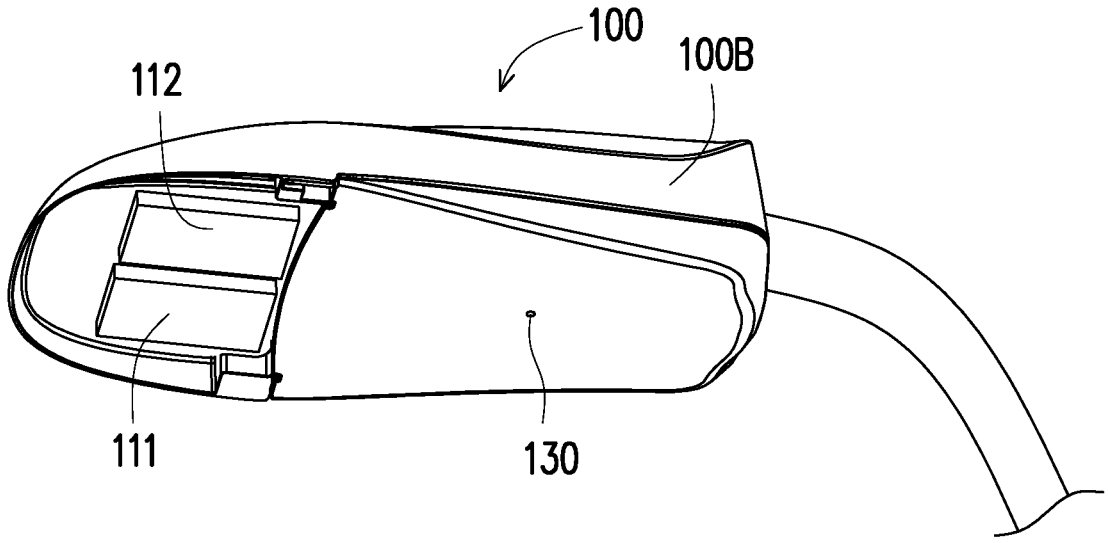
FIG. 2 is a schematic view of a street light device according to an embodiment of the disclosure.

FIG. 2 is a schematic view of a street light device according to an embodiment of the disclosure. Referring to FIG. 1 and FIG. 2, the hardware configuration of the street light device 100 may be as shown in FIG. 2, but the disclosure is not limited thereto. In this embodiment, the street light device 100 includes a device body 100B and is coupled to the external power supply apparatus 200. The device body 100B houses the light emitting module 110, the driving circuit 120, the sensing module 130, the microcontroller 140, and the AC to DC converter 150. In this embodiment, the first light emitting unit 111 and the second light emitting unit 112 may be juxtaposed to respectively emit an illumination light toward an illumination area, and the sensing module 130 senses the illumination area to obtain environmental parameters of the surrounding environment of the illumination area or the street light device 100. The environmental parameters include temperature, relative humidity, and dust concentration.

In this embodiment, the microcontroller 140 of this embodiment calculates the light attenuation rate S (%) according to the following Formula (1).

$$\frac{\alpha \times \left(0.6219 \times \frac{P_S \times RH}{P - P_S \times RH} \times \rho_{dry\ air}\right) + \beta \times \frac{PM}{10^9}}{\rho_{dry\ air}} - 100\% = S(\%) \qquad \text{Formula (1)}$$

In the above Formula (1), P is the atmospheric pressure (Pa) in a standard state. $P_S$ is the saturated vapor pressure (Pa). RH is the relative humidity (%). $\rho_{dry\ air}$ is the density of dry air (kg/m$^3$). PM is the dust concentration (μg/m$^3$). α and β are operating coefficients.

The processes of the microcontroller 140 obtaining the light attenuation rate S (%) are described in detail as below. First, the microcontroller 140 obtains the temperature, the relative humidity RH, and the dust concentration PM respectively through the temperature sensor 131, the humidity sensor 132, and the dust concentration sensor 133. Then, the microcontroller 140 calculates the saturated vapor pressure $P_S$ according to the temperature, and calculates the density of moist air (kg/m$^3$) according to the relative humidity RH, the saturated vapor pressure $P_S$, and the density of dry air $\rho_{dry\ air}$, such as the following Formula (2).

$$\left(0.6219 \times \frac{P_S \times RH}{P - P_S \times RH} \times \rho_{dry\ air}\right) \qquad \text{Formula (2)}$$

Finally, the microcontroller 140 multiplies the density of moist air by the operating coefficient α, adds the result of the dust concentration PM multiplying by the operating coefficient β and multiplying by $1/10^9$, then is divided by the density of dry air $\rho_{dry\ air}$, then minuses 100%, and the light attenuation rate S (%) is thereby obtained.

In other words, the street light device 100 of this embodiment calculates the current difference ratio (i.e., the above-described light attenuation rate S (%)) of the density of mixed air to the density of dry air of the surrounding environment of the street light device 100 by instantaneously and automatically sensing the temperature, the relative humidity, and the dust concentration of the surrounding environment of the street light device 100, and dynamically adjusts the brightness of the first light emitting unit 111 and the second light emitting unit 112 according to the calculation result, so that the color temperature ratio between the first light emitting unit 111 and the second light emitting unit 112 is determined according to the light attenuation rate. Compared with general nephelometers, the temperature sensor 131, the humidity sensor 132, and the dust concentration sensor 133 have the advantages of small size and low cost for installation.

Figure 3:
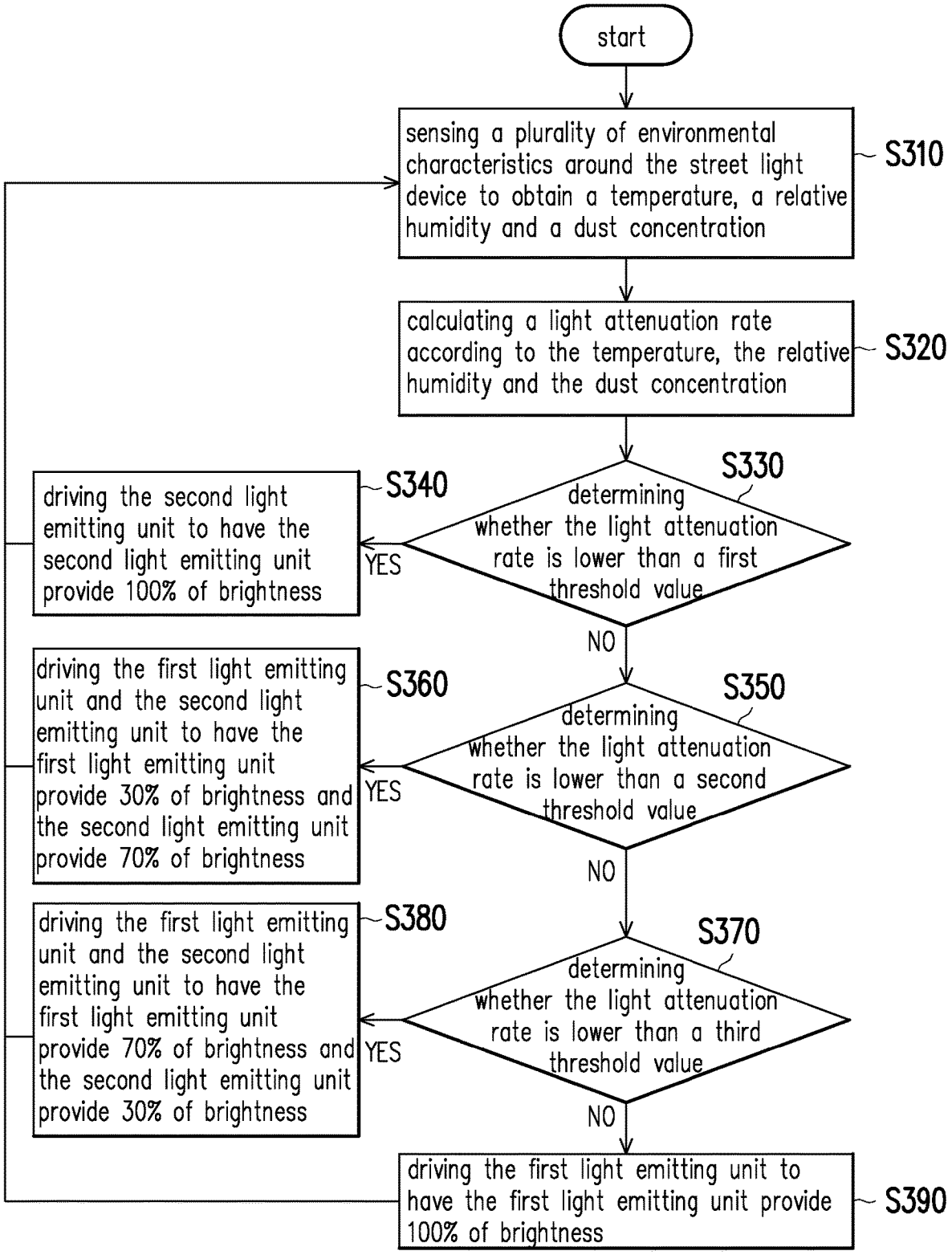
FIG. 3 is a flowchart of an operation method of a street light device according to an embodiment of the disclosure.

FIG. 3 is a flowchart of an operation method of a street light device according to an embodiment of the disclosure. Referring to FIG. 1 and FIG. 3, the method of FIG. 3 is at least applicable to the street light device 100 shown in FIG. 1 and the street light device 100 shown in FIG. 2. In this embodiment, the first light emitting unit 111 may have a fixed first color temperature, and the second light emitting unit 112 may have a fixed second color temperature, wherein the first color temperature is lower than the second color temperature. In this embodiment, the microcontroller 140 may preset one or more than one threshold values to dynamically adjust the first driving current DC1 output to the first light emitting unit 111 via the driving circuit 120 and the second driving current DC2 output to the second light emitting unit 112 via the driving circuit 120 by determining the relationship between the light attenuation rate and the threshold values. In this embodiment, the value of the light attenuation rate is proportional to the current value of the first driving current DC1, and the value of the light attenuation rate is inversely proportional to the current value DC2 of the second driving current. In other words, when the light attenuation rate gets higher, the brightness of the first light emitting unit 111 gets higher as the brightness of the second light emitting unit 112 gets lower. In contrast, when the light attenuation rate gets lower, the brightness of the first light emitting unit 111 gets lower as the brightness of the second light emitting unit 112 gets higher.

For example, the microcontroller 140 may preset three threshold values for the street light device 100 to perform step S310 to step S390. In step S310, the street light device 100 senses a plurality of environmental characteristics around the street light device 100 by the sensing module 130 to obtain a temperature, a relative humidity, and a dust concentration. In step S320, the microcontroller 140 of the street light device 100 calculates a light attenuation rate (i.e., the light attenuation rate S (%) as described in the above embodiment) according to the temperature, the relative humidity, and the dust concentration. In step S330, the microcontroller 140 determines whether the light attenuation rate is lower than a first threshold value. If yes, the microcontroller 140 performs step S340. In step S340, the microcontroller 140 drives the second light emitting unit 112 to have the second light emitting unit 112 provide 100% of brightness, and performs step S310 again. In other words, if the light attenuation rate is lower than the first threshold value, it indicates that the current visibility around the street light device 100 is high, so the street light device 100 only needs to provide an illumination light (for example, a white light with a color temperature of 5000K) with the second light emitting unit 112.

In step S330, if the microcontroller 140 determines that the light attenuation rate is not lower than the first threshold value, the microcontroller 140 performs step S350. In step S350, the microcontroller 140 determines whether the light attenuation rate is lower than a second threshold value. The second threshold value is higher than the first threshold value. If yes, the microcontroller 140 performs step S360. In step S360, the microcontroller 140 drives the first light emitting unit 111 and the second light emitting unit 112 to have the first light emitting unit 111 provide 30% of brightness and the second light emitting unit 112 provide 70% of brightness, and performs step S310 again. In other words, if the light attenuation rate falls between the first threshold value and the second threshold value, it indicates that the current visibility around the street light device 100 is slightly low, so the street light device 100 provides an illumination light (for example, a yellow light with a color temperature of 2700K) of 30% of brightness with the first light emitting unit 111 and an illumination light of 70% of brightness with the second light emitting unit 111 simultaneously.

In step S350, if the microcontroller 140 determines that the light attenuation rate is not lower than the second threshold value, the microcontroller 140 performs step S370. In step S370, the microcontroller 140 determines whether the light attenuation rate is lower than a third threshold value. The third threshold value is higher than the second threshold value. If yes, the microcontroller 140 performs step S380. In step S380, the microcontroller 140 drives the first light emitting unit 111 and the second light emitting unit 112 to have the first light emitting unit 111 provide 70% of brightness and the second light emitting unit 112 provide 30% of brightness, and performs step S310 again. In other words, if the light attenuation rate falls between the second threshold value and the third threshold value, it indicates that the current visibility around the street light device 100 is quite low, so the street light device 100 provides an illumination light of 70% of brightness with the first light emitting unit 111 and an illumination light of 30% of brightness with the second light emitting unit 111 simultaneously.

In step S370, if the microcontroller 140 determines that the light attenuation rate is not lower than the third threshold value, the microcontroller 140 performs step S390. In step S390, the microcontroller 140 drives the first light emitting unit 111 to have the first light emitting unit 111 provide 100% of brightness, and performs step S310 again. In other words, if the light attenuation rate is higher than the third threshold value, it indicates that the current visibility around the street light device 100 is really low, so the street light device 100 needs to provide an illumination light with the first light emitting unit 111 of 100% of brightness.

Figure 4:
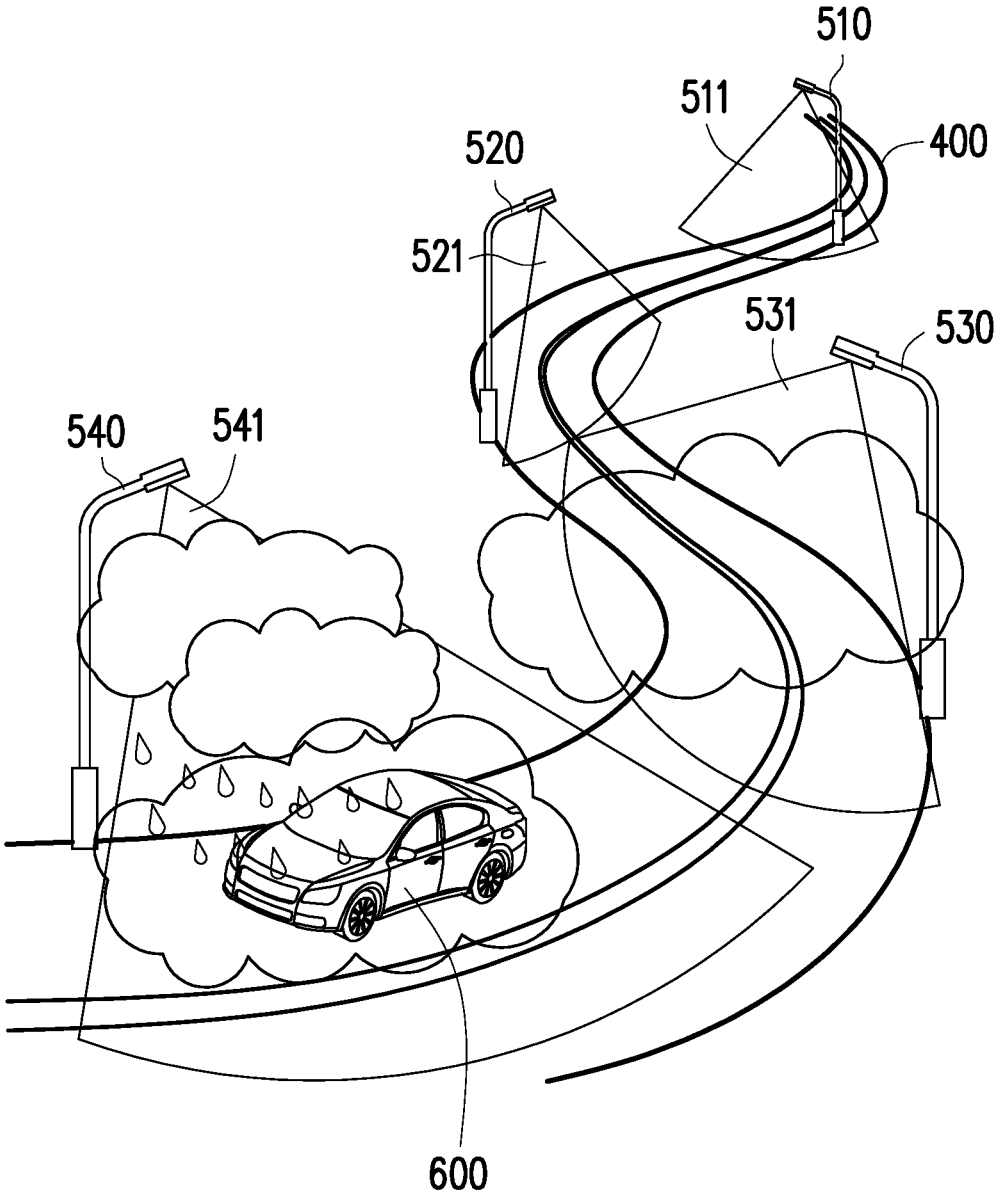
FIG. 4 is a schematic view of a street light system according to an embodiment of the disclosure.

FIG. 4 is a schematic view of a street light system according to an embodiment of the disclosure. Referring to FIG. 3 and FIG. 4, a plurality of street light devices 510 to 540 of FIG. 4 are sequentially disposed beside the road 400 to generate a plurality of illumination areas 511 to 541 at a plurality of locations on the road 400, respectively. In this embodiment, the street light device 510 to 540 may independently perform the operation method of the embodiment of FIG. 3 as described above. For example, when a vehicle 600 passes through an illumination area 511, the street light device 510 may automatically determine that it is not raining and not foggy in the illumination area 511 (high visibility), so the street light device 510 may perform step S340 as described above to provide 100% of white light. When a vehicle 600 passes through an illumination area 521, the street light device 520 may automatically determine that it is not raining but slightly foggy in the illumination area 521 (slightly low visibility), so the street light device 520 may perform step S360 as described above to provide 30% of yellow light and 70% of white light. When a vehicle 600 passes through an illumination area 531, the street light device 530 may automatically determine that there is heavy fog in the illumination area 531 (quite low visibility), so the street light device 530 may perform step S380 as described above to provide 70% of yellow light and 30% of white light. When a vehicle 600 passes through an illumination area 541, the street light device 540 may automatically determine that it is raining with heavy fog in the illumination area 541 (really low visibility), so the street light device 540 may perform step S390 as described above to provide 100% of yellow light. Accordingly, the street light devices 510 to 540 of the street lamp system of this embodiment respectively sense the environmental parameters of the corresponding illumination area to automatically determine the visibility therein. Therefore, the street light devices 510 to 540 of this embodiment automatically adjust the color temperature of the illumination light effectively according to the visibility of the corresponding illumination area.

Furthermore, other circuit details and operation method of the street light devices 510 to 540 of this embodiment may be understood sufficiently from the teaching, suggestion, and illustration of the embodiments of FIG. 1 to FIG. 3 and thus are not repeated hereinafter.

Figure 5:
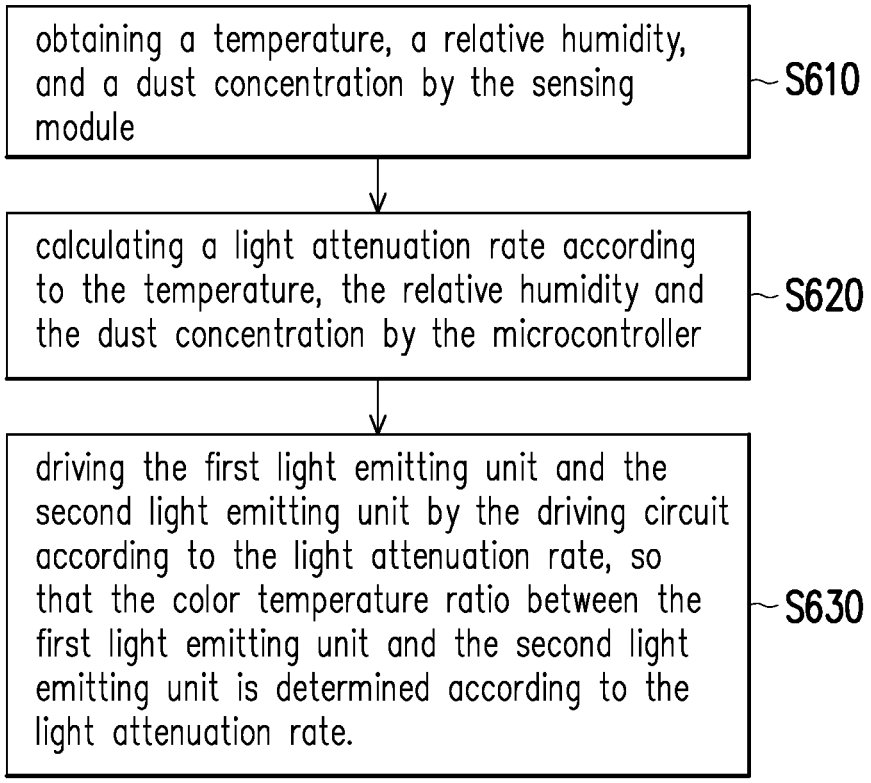
FIG. 5 is a flowchart of an operation method of a street light device according to an embodiment of the disclosure.

FIG. 5 is a flowchart of an operation method of a street light device according to an embodiment of the disclosure. Referring to FIG. 1, FIG. 2 and FIG. 5, the method of FIG. 5 is at least applicable to the street light device 100 shown in FIG. 1 and the street light device 100 shown in FIG. 2. The street light device 100 may perform step S610 to step S630. In step S610, the microcontroller 140 obtains a temperature, a relative humidity, and a dust concentration by the sensing module 130. In step S620, the microcontroller 140 calculates a light attenuation rate according to the temperature, the relative humidity, and the dust concentration. In step S630, the microcontroller 140 drives the first light emitting unit 111 and the second light emitting unit 112 according to the light attenuation rate, so that the color temperature ratio between the first light emitting unit 111 and the second light emitting unit 112 is determined according to the light attenuation rate. As such, the street light device 100 may effectively adjust a color temperature ratio between the first light emitting unit 111 and the second light emitting unit 112.

Furthermore, other circuit details and operation method of the street light devices 100 of this embodiment may be understood sufficiently from the teaching, suggestion, and illustration of the embodiments of FIG. 1 to FIG. 4 and thus are not repeated hereinafter.

Figure 6:
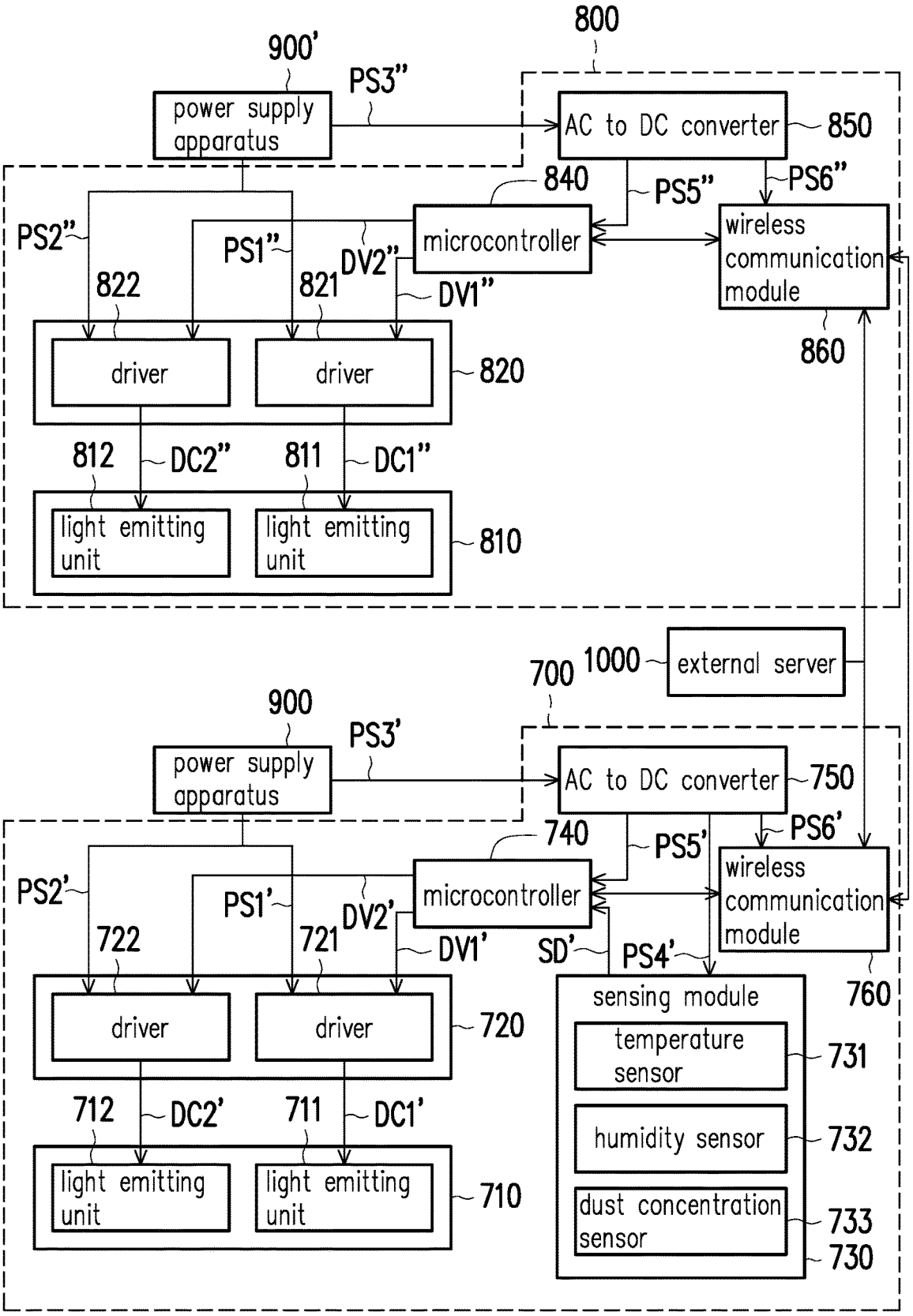
FIG. 6 is a schematic view of a functional circuit diagram of a street light system according to an embodiment of the disclosure.

FIG. 6 is a schematic view of a functional circuit diagram of a street light system according to an embodiment of the disclosure. Referring to FIG. 6, a street light system 70 includes a master street light device 700 and a slave street light device 800. The master street light device 700 includes a light emitting module 710, a driving circuit 720, a sensing module 730, a microcontroller 740, an AC to DC converter 750, and a wireless communication module 760. The master street light device 700 may be coupled to an external power supply apparatus 900, and the power supply apparatus 900 may be, for example, the domestic power. The light emitting module 710 includes light emitting units 711 and 712. The driving circuit 720 includes drivers 721 and 722. The sensing module 730 includes a temperature sensor 731, a humidity sensor 732, and a dust concentration sensor 733. In this embodiment, the power supply apparatus 700 is adapted to respectively provide an AC power signal PS1' and an AC power signal PS2' to the drivers 721 and 722, and to provide an AC power signal PS3' to the AC to DC converter 750. The AC to DC converter 750 is adapted to convert the AC power signal PS3' into a DC power signal PS4', a DC power signal PS5', and a DC power signal PS6', and to respectively provide the DC power signal PS4', the DC power signal PS5', and the DC power signal PS6' to the sensing module 730, the microcontroller 740, and the wireless communication module 760.

In this embodiment, the master street light device 700 may perform the same related operations as the street light device 100 of FIG. 1. Therefore, the embodiments and descriptions of the dimming voltages DV1', DV2', the driving currents DC1', DC2', the sensing data SD', the color temperature, and the color temperature ratio are not repeated hereinafter.

However, compared with the embodiment of FIG. 1, in this embodiment, the master street light device 700 further includes the wireless communication module 760. The wireless communication module 760 is configured to communicate with an external server 1000 and the wireless communication module 860 of the slave street light device 800. The wireless communication module 760 and the wireless communication module 860 may be, for example, a ZigBee module, a LoRa module, a Bluetooth module or a Narrow Band-Internet of Things (NB-IOT) module, but the disclosure is not limited thereto. In this embodiment, when the master street light device 700 obtains a temperature, a relative humidity, and a dust concentration by the sensing module 730, the master street light device 700 may upload the temperature, the relative humidity, and the dust concentration to the external server 1000. In another embodiment, the master street light device 700 may calculate a light attenuation rate according to the temperature, the relative humidity, and the dust concentration, and then upload the light attenuation rate to the external server 1000. The external server 1000 may be a cloud server, but the disclosure is not limited thereto. In other words, the external server 1000 of the disclosure may effectively record an environmental sensing history of the master street light device 700, and may, for example, utilize the environmental sensing history to perform a big data analysis.

The slave street light device 800 includes a light emitting module 810, a driving circuit 820, a microcontroller 840, an AC to DC converter 850, and a wireless communication module 860. The slave street light device 800 may be coupled to an external power supply apparatus 900', and the power supply apparatus 900' may be the same as the power supply apparatus 900. The light emitting module 810 includes a light emitting units 811 and 812. The driving circuit 820 includes drivers 821 and 822. In this embodiment, the power supply apparatus 900' is adapted to respectively provide an AC power signal PS1" and an AC power signal PS2" to the drivers 821 and 822, and to provide an AC power signal PS3" to the AC to DC converter 850. The AC to DC converter 850 is adapted to convert the AC power signal PS3" into a DC power signal PS5" and a DC power signal PS6", and to respectively provide the DC power signal PS5" and the DC power signal PS6" to the microcontroller 840 and the wireless communication module 860.

In this embodiment, the slave street light device 800 may perform the same related operations as the street light device 100 of FIG. 1. Therefore, the embodiments and descriptions of the dimming voltages DV1", DV2", the driving currents DC1", DC2", the color temperature, and the color temperature ratio are not repeated hereinafter. However, compared with the embodiment of FIG. 1, in this embodiment, the slave street light device 800 further includes the wireless communication module 860, and lacks the sensing module. The wireless communication module 860 is configured to communicate with the external server 1000 and the master street light device 700. In this embodiment, when the master street light device 700 has calculated the light attenuation rate, the master street light device 700 may transmit the light attenuation rate to the slave street light device 800 by the wireless communication module 760. Hence, the wireless communication module 860 may receive and transmit the light attenuation rate to the microcontroller 840, so that the microcontroller 840 may control the driving circuit 820 to directly drive the light emitting module 810. Therefore, the slave street light device 800 does not require extra time to sense the environmental parameters and to calculate the light attenuation rate. However, in another embodiment, the master street light device 700 may transmit the temperature, the relative humidity, and the dust concentration to the slave street light device 800, so that the slave street light device 800 does not require extra time to sense the environmental parameters, and merely require to calculate the light attenuation rate according to the temperature, the relative humidity, and the dust concentration. In yet another embodiment, the slave street light device 800 may also receive the light attenuation rate from the external server 1000, or receive the temperature, the relative humidity, and the dust concentration from the external server 1000.

Moreover, in another embodiment, when the master street light device 700 has calculated the light attenuation rate, the master street light device 700 may broadcast to one or more slave street light devices within the communication range at the same time, and provide the light attenuation rate to the one or more slave street light devices. In other words, due to the environmental conditions of the slave street light devices adjacent to the master street light device 700 may be similar to the environmental conditions of the master street light device 700, so that the light attenuation rates corresponding to the slave street light devices may also be similar to the light attenuation rates corresponding to the master street light devices 700. Therefore, the slave street light devices do not require to sense the environmental parameters again, even not require to calculate the light attenuation rate again. In a specific illumination area, the slave street light devices adjacent to the master street light device 700 may provide same illumination effect having a corresponding color temperature based on the environmental condition of the specific illumination area.

Furthermore, other circuit details and operation method of the master street light device 700 and the slave street light device 800 of this embodiment may be understood sufficiently from the teaching, suggestion, and illustration of the embodiments of FIG. 1 to FIG. 5 and thus are not repeated hereinafter.

Figure 7:
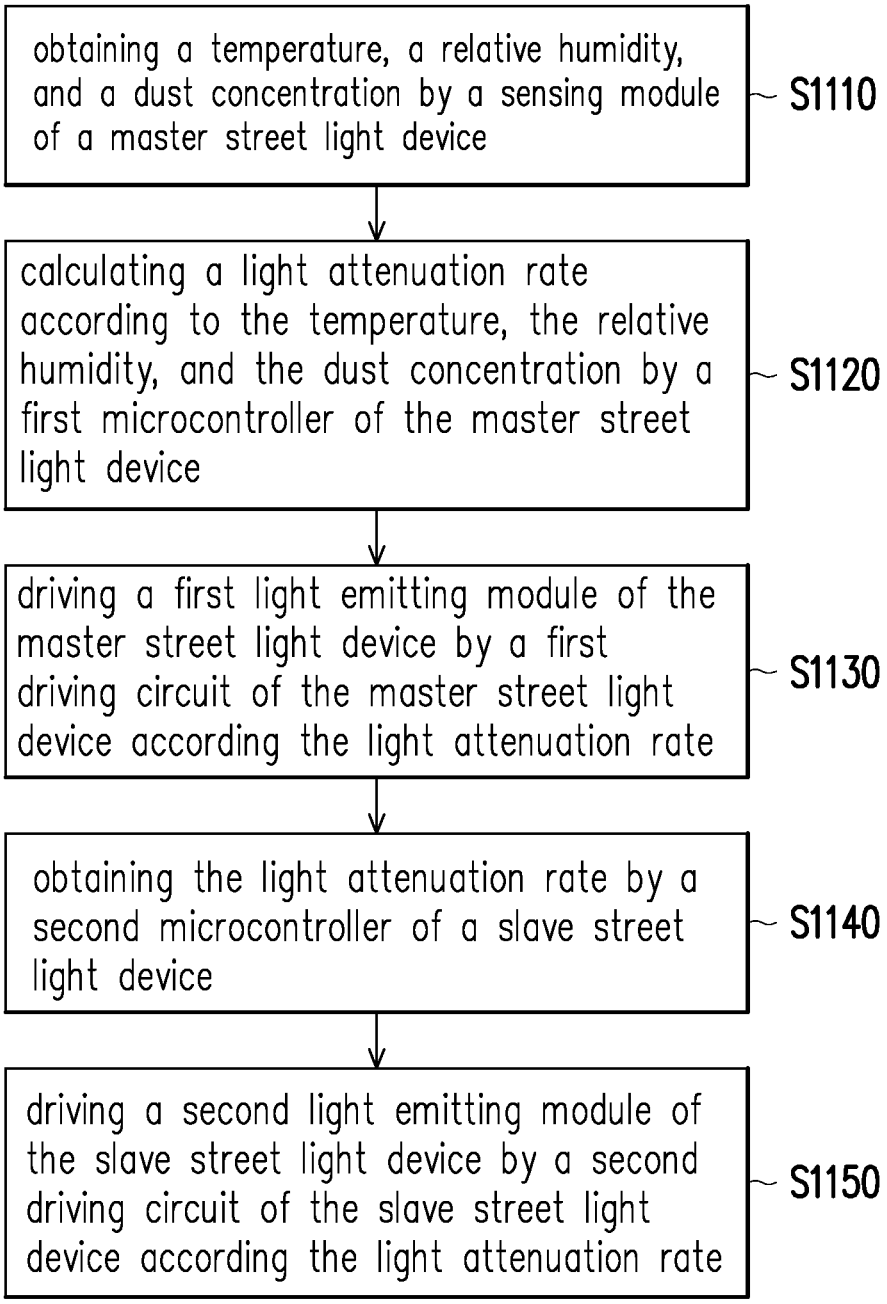
FIG. 7 is a flowchart of an operation method of a street light system according to an embodiment of the disclosure.

FIG. 7 is a flowchart of an operation method of a street light system according to an embodiment of the disclosure. Referring to FIG. 6 and FIG. 7, the method of FIG. 7 is at least applicable to the street light system 70 shown in FIG. 6. The street light system 70 may perform step S1110 to step S1150. In step S1110, the microcontroller 740 of the master street light device 700 obtains a temperature, a relative humidity, and a dust concentration by the sensing module 730 of the master street light device 700. In step S1120, the microcontroller 740 of the master street light device 700 calculates a light attenuation rate according to the temperature, the relative humidity, and the dust concentration. In step S1130, the microcontroller 740 controls the driving circuit 720 of the master street light device 700 to drive the light emitting module 710 of the master street light device 700 according the light attenuation rate. In step S1140, the microcontroller 840 of the slave street light device 800 obtains the light attenuation rate from the master street light device 700. In step S1150, the microcontroller 840 controls the driving circuit 820 of the slave street light device 800 to drive the light emitting module 810 of the slave street light device 800 according the light attenuation rate. As such, the street light system 70 may efficiently provide an appropriate illumination effect by a plurality of street light devices at same time.

Furthermore, other circuit details and operation method of the street light system 70 of this embodiment may be understood sufficiently from the teaching, suggestion, and illustration of the embodiments of FIG. 1 to FIG. 6 and thus are not repeated hereinafter.

Figure 8:
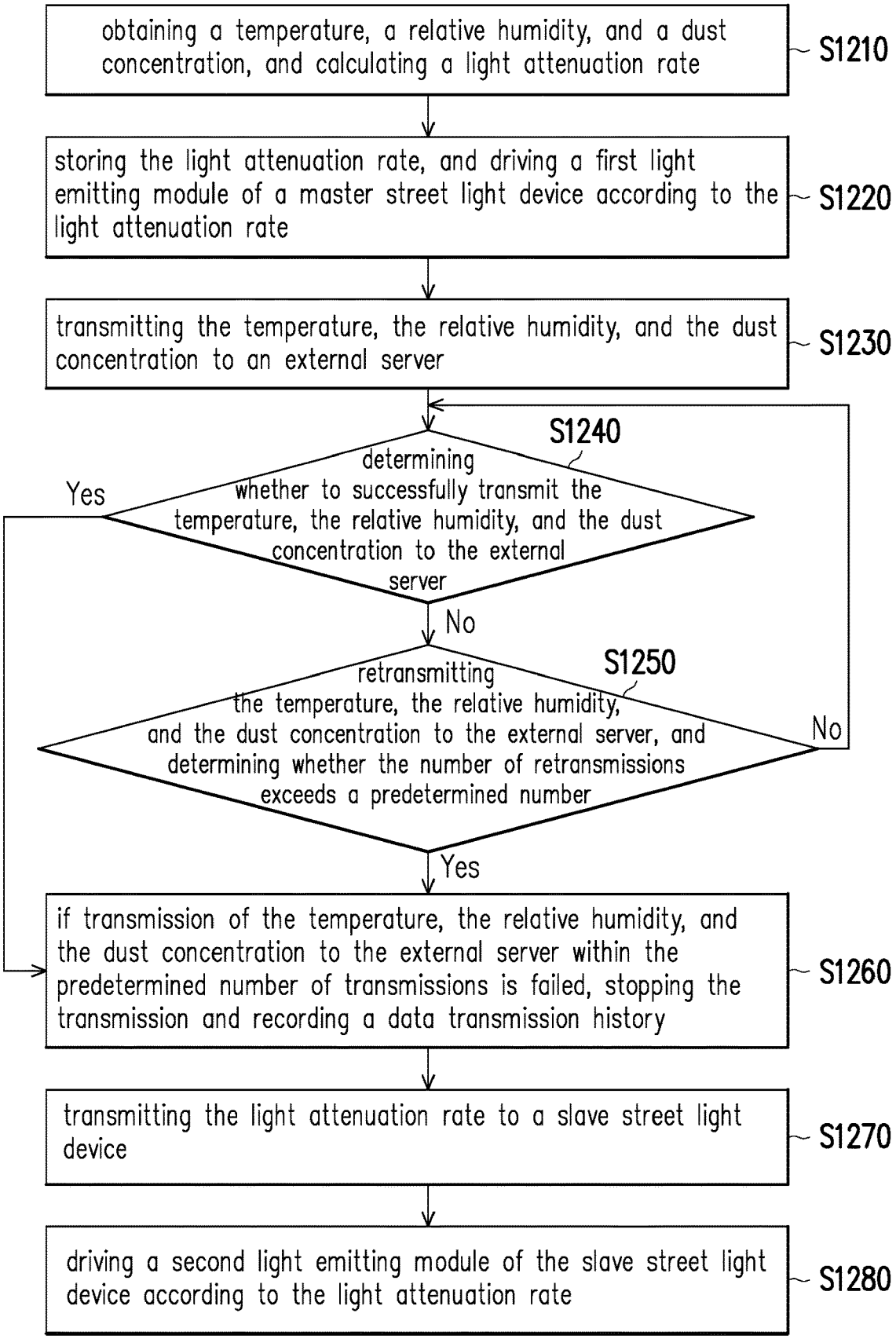
FIG. 8 is a flowchart of an operation method of a street light system according to another embodiment of the disclosure.

FIG. 8 is a flowchart of an operation method of a street light system according to another embodiment of the disclosure. Referring to FIG. 6 and FIG. 8, the method of FIG. 8 is at least applicable to the street light system 70 shown in FIG. 6. The street light system 70 may perform step S1210 to step S1280. In step S1210, the master street light device 700 obtains a temperature, a relative humidity, and a dust concentration, and calculates a light attenuation rate according to the temperature, the relative humidity, and the dust concentration. In step S1220, the master street light device 700 stores the light attenuation rate, for example, to an external memory, and drives the light emitting module 710 of the master street light device 700 according to the light attenuation rate. In step S1230, the master street light device 700 transmits the temperature, the relative humidity, and the dust concentration to the external server 1000. In step S1240, the master street light device 700 determines whether to successfully transmit the temperature, the relative humidity, and the dust concentration to the external server 1000. If no, the street light system 70 continues to perform step S1250. If yes, the street light system 70 continues to perform step S1260.

In step S1250, the master street light device 700 retransmits the temperature, the relative humidity, and the dust concentration to the external server 1000, and determine whether the number of retransmissions exceeds a predetermined number of times, such as two or three times. If no, the street light system 70 performs step S1240 again. If yes, the street light system 70 continues to perform step S1260. In step S1260, if the microcontroller 740 determines the wireless communication module 760 fails to transmit the temperature, the relative humidity, and the dust concentration to the external server 1000 within a predetermined number of transmissions, the microcontroller 740 stops the transmission and recording a data transmission history into a memory of master street light device 700 or an external storage apparatus. In step S1270, the master street light device 700 transmits the light attenuation rate to the slave street light device 800. In step S1280, the slave street light device 800 drives the light emitting module 810 of the slave street light device 800 according to the light attenuation rate. In other words, the master street light device 700 attempts to upload the temperature, the relative humidity, and the dust concentration to the external server 1000. However, no matter whether the master street light device 700 successfully transmits the temperature, the relative humidity, and the dust concentration to the external server 1000, the master street light device 700 will transmit the light attenuation rate to the slave street light device 800, so that the master street light device 700 and the slave street light device 800 may provide same illumination effect at the same time.

Furthermore, other circuit details and operation method of the street light system 70 of this embodiment may be understood sufficiently from the teaching, suggestion, and illustration of the embodiments of FIG. 1 to FIG. 7 and thus are not repeated hereinafter.

In summary, the street light system and an operation method thereof of this disclosure are capable of calculating a light attenuation rate by automatically sensing the temperature, the relative humidity, and the dust concentration of the surrounding environment of the master street light device. Moreover, the master street light device provides the light attenuation rate to the slave street light device, so that the slave street light device can provide same illumination effect. Thus, the slave street light device does not require extra time to sense the environmental parameters, and even not require to calculate the light attenuation rate. Therefore, the street light system and an operation method thereof of this disclosure are capable of efficiently providing appropriate illumination effect by a plurality of street light device at the same time.

It will be apparent to those skilled in the art that various modifications and variations can be made to the disclosed embodiments without departing from the scope or spirit of this disclosure. In view of the foregoing, it is intended that the disclosure covers modifications and variations provided that they fall within the scope of the following claims and their equivalents.

What is claimed is:

1. A street light system, comprising:

a master street light device, comprising:

a first light emitting module;

a sensing module, configured to obtain a temperature, a relative humidity, and a dust concentration;

a first microcontroller, coupled to the sensing module, and configured to calculate a light attenuation rate according to the temperature, the relative humidity, and the dust concentration; and a first driving circuit, coupled to the first microcontroller and the first light emitting module, and configured to drive the first light emitting module according the light attenuation rate; and a slave street light device, coupled to the master street light device, and comprising:

a second light emitting module;

a second microcontroller, configured to obtain the light attenuation rate; and a second driving circuit, coupled to the second microcontroller and the second light emitting module, and configured to drive the second light emitting module according the light attenuation rate.

2. The street light system according to the claim 1, wherein the master street light device further comprises:

a first wireless communication module, coupled to the first microcontroller, wherein the first microcontroller further configured to store the light attenuation rate, and transmit the temperature, the relative humidity, and the dust concentration to an external server by the first wireless communication module.

3. The street light system according to the claim 2, wherein the first microcontroller determines the first wireless communication module fails to transmit the temperature, the relative humidity, and the dust concentration to an external server within a predetermined number of transmissions, the first microcontroller stops transmitting and records a data transmission history.

4. The street light system according to the claim 2, wherein the slave street light device further comprises:

a second wireless communication module, coupled to the second microcontroller, and configured to communicate with the first wireless communication module, wherein the first microcontroller further configured to transmit the light attenuation rate to the second wireless communication module by the first wireless communication module, so that the second microcontroller receives the light attenuation rate transmitted by the second wireless communication module.

5. The street light system according to the claim 2, wherein the slave street light device further comprises:

a second wireless communication module, coupled to the second microcontroller, and configured to communicate with the external server, wherein the second wireless communication module receives the light attenuation rate calculated by the external server from the external server.

6. The street light system according to the claim 2, wherein the slave street light device further comprises:

a second wireless communication module, coupled to the second microcontroller, and configured to communicate with the external server, wherein the second wireless communication module receives the temperature, the relative humidity, and the dust concentration from the external server, and the second microcontroller calculates the light attenuation rate according to the temperature, the relative humidity, and the dust concentration.

7. The street light system according to the claim 1, wherein the first light emitting module comprises a first light emitting unit and a second light emitting unit, wherein the first microcontroller controls the first driving circuit according to the light attenuation rate to drive the first light emitting unit and the second light emitting unit, so that a first color temperature ratio between the first light emitting unit and the second light emitting unit is determined according to the light attenuation rate.

8. The street light system according to the claim 7, wherein the first light emitting unit has a first color temperature, and the second light emitting unit has a second color temperature, wherein the first color temperature is lower than the second color temperature.

9. The street light system according to the claim 1, wherein the second light emitting module comprises a third light emitting unit and a fourth light emitting unit, wherein the second microcontroller controls the second driving circuit according to the light attenuation rate to drive the third light emitting unit and the fourth light emitting unit, so that a second color temperature ratio between the third light emitting unit and the fourth light emitting unit is determined according to the light attenuation rate.

10. The street light system according to the claim 9, wherein the third light emitting unit has a third color temperature, and the fourth light emitting unit has a fourth color temperature, wherein the third color temperature is lower than the fourth color temperature.

11. A operation method of a street light system, wherein the street light system comprises a master street light device and a slave street light device, wherein the operation method comprises:

obtaining a temperature, a relative humidity, and a dust concentration by a sensing module of the master street light device;

calculating a light attenuation rate according to the temperature, the relative humidity, and the dust concentration by a first microcontroller of the master street light device;

driving a first light emitting module of the master street light device by a first driving circuit of the master street light device according the light attenuation rate;

obtaining the light attenuation rate by a second microcontroller of the slave street light device; and driving a second light emitting module of the slave street light device by a second driving circuit of the slave street light device according the light attenuation rate.

12. The operation method according to the claim 11, further comprising:

storing the light attenuation rate by the first microcontroller; and transmitting the temperature, the relative humidity, and the dust concentration to an external server by a first wireless communication module of the master street light device.

13. The operation method according to the claim 12, further comprising:

if the first microcontroller determines the first wireless communication module fails to transmit the temperature, the relative humidity, and the dust concentration to an external server within a predetermined number of transmissions, stopping transmission and recording a data transmission history by the first microcontroller.

14. The operation method according to the claim 12, wherein the step of obtaining the light attenuation rate by the second microcontroller of the slave street light device comprises:

transmitting the light attenuation rate to the second wireless communication module by the first wireless communication module; and receiving the light attenuation rate transmitted by the second wireless communication module.

15. The operation method according to the claim 12, wherein the step of obtaining the light attenuation rate by the second microcontroller of the slave street light device comprises:

receiving the light attenuation rate calculated by the external server from the external server by the second wireless communication module.

16. The operation method according to the claim 12, wherein the step of obtaining the light attenuation rate by the second microcontroller of the slave street light device comprises:

receiving the temperature, the relative humidity, and the dust concentration from the external server by the second wireless communication module; and calculating the light attenuation rate by the second microcontroller according to the temperature, the relative humidity, and the dust concentration.

17. The operation method according to the claim 11, wherein the first light emitting module comprises a first light emitting unit and a second light emitting unit, and the step of driving the first light emitting module of the master street light device by the first driving circuit of the master street light device according the light attenuation rate comprise:

controlling the first driving circuit by the first microcontroller according to the light attenuation rate to drive the first light emitting unit and the second light emitting unit, so that a first color temperature ratio between the first light emitting unit and the second light emitting unit is determined according to the light attenuation rate.

18. The operation method according to the claim 17, wherein the first light emitting unit has a first color temperature, and the second light emitting unit has a second color temperature, wherein the first color temperature is lower than the second color temperature.

19. The operation method according to the claim 11, wherein the second light emitting module comprises a third light emitting unit and a fourth light emitting unit, and the step of driving the second light emitting module of the slave street light device by the second driving circuit of the slave street light device according the light attenuation rate comprises:

controlling the second driving circuit by the second microcontroller according to the light attenuation rate to drive the third light emitting unit and the fourth light emitting unit, so that a second color temperature ratio between the third light emitting unit and the fourth light emitting unit is determined according to the light attenuation rate.

20. The operation method according to the claim 19, wherein the third light emitting unit has a third color temperature, and the fourth light emitting unit has a fourth color temperature, wherein the third color temperature is lower than the fourth color temperature.

* * * * *